US006896097B2

(12) United States Patent
Nishikawa et al.

(10) Patent No.: US 6,896,097 B2
(45) Date of Patent: May 24, 2005

(54) MOUNTING STRUCTURE OF SPEAKER FOR VEHICLE

(75) Inventors: Akira Nishikawa, Hyogo (JP); Akira Motojima, Hyogo (JP); Hiroyuki Yoshii, Nara (JP)

(73) Assignee: Fujitsu Ten Limited, Kobe (JP)

( * ) Notice: Subject to any disclaimer, the term of this patent is extended or adjusted under 35 U.S.C. 154(b) by 72 days.

(21) Appl. No.: 10/449,610

(22) Filed: Jun. 2, 2003

(65) Prior Publication Data

US 2003/0226712 A1 Dec. 11, 2003

(30) Foreign Application Priority Data

Jun. 7, 2002 (JP) ..... 2002-167799

(51) Int. Cl.[7] ..... A47B 81/06

(52) U.S. Cl. ..... 181/199; 181/198; 181/205; 181/200; 181/207; 181/208

(58) Field of Search ..... 181/199, 198, 181/200, 205, 207, 208

(56) References Cited

U.S. PATENT DOCUMENTS 4,127,751 A * 11/1978 Kinoshita ..... 181/199
5,194,701 A * 3/1993 Yamada-Scriba ..... 181/151
5,942,734 A * 8/1999 Calvert et al. ..... 181/151

FOREIGN PATENT DOCUMENTS

| | | |
|---|---|---|
| JP | A 5-56830 | 3/1993 |
| JP | A 5-187422 | 7/1993 |
| JP | A 5-276588 | 10/1993 |
| JP | A 11-54963 | 2/1999 |

* cited by examiner

*Primary Examiner*—Shih-yung Hsieh
(74) *Attorney, Agent, or Firm*—Oliff & Berridge, PLC

(57) ABSTRACT

A speaker box is covered with a buffer material exclusive of a portion where an acoustic output is derived from a speaker unit. The speaker box covered with the buffer material is attached to the surface of a wall member such as an interior member of a vehicle body or a side plate outside the vehicle body in a manner the speaker box is pressed by a holding member, which is a part of the interior member or designed member, and secured by bolts. Even when the surface of the speaker box is vibrated, the buffer material prevents an acoustic output due to the vibration from being generated so that no unnecessary acoustic signal is generated.

4 Claims, 5 Drawing Sheets

MOUNTING STRUCTURE OF SPEAKER FOR VEHICLE

BACKGROUND OF THE INVENTION

1. Field of the Invention

This invention relates to a mounting structure of a speaker to be mounted on a vehicle (hereinafter referred to as "speaker for vehicle") for performing acoustic reproduction in a passenger room.

2. Description of the Related Art

As seen from FIG. 4, conventionally, a vehicle 1 such as a passenger car has various speakers for car audio. Generally, since a passenger in a room 2 such as a driver of the vehicle 1 listens to left-right two-channel stereophonic reproduction in a posture facing forward of the vehicle 1, speakers 3, 4 and 5 are mounted at left and right positions in spaces in an instrument panel 6, left and right front doors 7 and 8, and a trunk room 9. Particularly, since the passenger (s) who listens to an acoustic output takes a posture facing forward of the vehicle 1, in many cases, the speaker for vehicles 3 and 4 are arranged in the instrument panel 6 on the front side of the passenger room 2 or the doors 7 and 8 on the side thereof. Since these portions do not have so large a usable space, there is a case in which bass speakers 5 are separately mounted in a space of a rear trunk room of the vehicle in a manner that they are opened in an upper rear tray. Since the directionality of an acoustic output is not so conspicuous at a low frequency, stereophonic feeling is not deteriorated so much in monophonic reproduction based on left and right synthesis in a bass range.

As a conventional mounting structure of a speaker for vehicle, FIG. 5A shows a structure in which the speaker for vehicle 4 shown in FIG. 4 is mounted in the door 7, and FIG. 5B shows a structure in which the speaker for vehicle 3 shown in FIG. 4 is mounted in the instrument panel 6. As seen from FIG. 5A, in many cases, a speaker unit 10 is attached to the door 7, and a space defined between an interior member 11 and a side plate 12 at the outermost position of a vehicle body serves as a speaker box. This space is provided to accommodate a door glass 13 when opening a window by lowering the door glass. The speaker unit 10 thus attached must not interfere the door glass 13. The speaker unit 10 has a flange 15 on the outer periphery of a frame 14. The flange 15 is secured to the periphery of an opening made in the interior member 11 by a bolt 16 and nut 17. As seen from FIG. 5B, the speaker 3 attached to the instrument panel 6 has a speaker unit 10 accommodated in a speaker box 18. A mount fitting 19 is secured by a bolt 16 and nut 17.

Regarding speakers attached for performing acoustic reproduction in a vehicle, JP-A-5-276588 discloses a prior art for arranging a bass range reproduction device in an armrest provided in a passenger room of a passenger car. JP-A-11-54963 discloses a prior art which uses a buffer material so as to cover the peripheral edge of an attaching hole when an electronic instrument to be mounted on a vehicle is attached to the attaching hole. Further, JP-A-5-187422 discloses a prior art applying a buffer material to a screw grommet used for fixing a spare tire in a trunk room of the vehicle. JP-A-5-56830 discloses a prior art of covering a speaker for performing an acoustic reproduction for a man sitting on a seat with a foaming elastic material serving as a core of a chair cover used for a sitting chair.

Such the speaker for vehicle must perform comfortable acoustic reproduction in a passenger room. For comfortable acoustic reproduction, it is required not only the sound quality in a frequency characteristic of the reproduced sound but also the transient sound quality to be good. When the acoustic output is reproduced from the speaker, the transient sound quality of the reproduced sound is deteriorated if the sound is also reproduced from the other portion than a diaphragm of the speaker. The sound is reproduced from the other portion than the diaphragm of the speaker when the frame of the speaker unit or an electric acoustic conversion portion such as a magnetic circuit vibrates, and the speaker box vibrates by the transmitted vibration owing to the counter force generated when the diaphragm of the speaker emits the acoustic output into the air.

If the speaker is covered with the foaming elastic material such as a chair cover as disclosed in JP-A-5-56830, it is expected that the unnecessary acoustic emission from the other portion than the diaphragm of the speaker is prevented. However, in this prior art, since the speaker is embedded in the chair cover to be mounted in the sitting chair, the speaker must be arranged for each seat when applying this prior art to the passenger room 2 of the vehicle 1 as shown in FIG. 4.

SUMMARY OF THE INVENTION

An object of the present invention is to provide a mounting structure of a speaker for vehicle, which does not generate unnecessary acoustic signal.

The present invention provides a mounting structure of a speaker for vehicle for mounting the speaker for vehicle on a vehicle body, having: the speaker for vehicle having an acoustic reproduce portion; a buffer material for covering portions of the speaker for vehicle other than the acoustic reproduce portion; and a holding member for holding the speaker for vehicle by pressing the buffer material.

According to the invention, the speaker for vehicle is covered with the buffer material, and attached to a vehicle body in such a manner that the buffer material is pressed by a holding member. Since the speaker for vehicle exclusive of a acoustic reproduce portion for performing acoustic reproduction in a passenger room is covered with the buffer material, even when vibration is generated by the counter-force when the speaker emits the acoustic reproduction into the air, the acoustic output due to the vibration is attenuated by the buffer material and disappears from the acoustic output actually reproduced from the speaker, thereby improving the sound quality of the sound actually reproduced.

In the present invention, at least a portion of the speaker for vehicle may be housed in a concave portion provided in the vehicle body, the buffer material may fill the periphery of the speaker for vehicle in the concave portion, and the holding member may press the buffer material from the side of an opening of the concave portion facing the passenger room.

According to the invention, the speaker for vehicle can be mounted in the concave portion of the vehicle body. The periphery of the speaker for vehicle is filled with the buffer material and the buffer material is pressed by the holding member from the side of an opening of the concave portion facing the passenger room. Therefore, the speaker for vehicle can be surely fixed in a state capable of performing the acoustic reproduction in the passenger room.

In the present invention, the speaker for vehicle may be mounted on the outside of a wall of the vehicle body in a manner that the acoustic reproduce portion faces an opening provided in the wall, and the holding member may hold the speaker for vehicle through the buffer material at the outside of the wall.

According to the invention, by providing an opening in a wall of a vehicle body, which faces a passenger room, the speaker for vehicle can be mounted on the back side of the wall in such a manner that the speaker for vehicle is mounted on the outside of the wall of the vehicle body and the acoustic reproduce portion faces the opening; the speaker for vehicle is covered with the buffer material and the buffer material is pressed by the holding member.

In the present invention, the speaker for vehicle may perform acoustic reproduction in a midrange frequency band containing the main part of sound, or in a treble range frequency band higher than the midrange frequency band.

According to the invention, since the acoustic reproduction is made in the midrange frequency band containing the main part of sound, or the treble range frequency band higher than the midrange frequency band, the midrange sound or treble sound can be reproduced with high sound quality. The speaker for vehicle for reproducing the midrange or treble range frequency band requires a reduced internal volume necessary for a speaker box so that the quantity of the buffer material to be used can be decreased, and the holding member can be downsized, thereby reducing the production cost. In general, "midrange frequency band" means a frequency band from a few hundred Hz to several kHz.

DETAILED DESCRIPTION OF THE PREFFERED EMBODIMENTS

Figure 1:
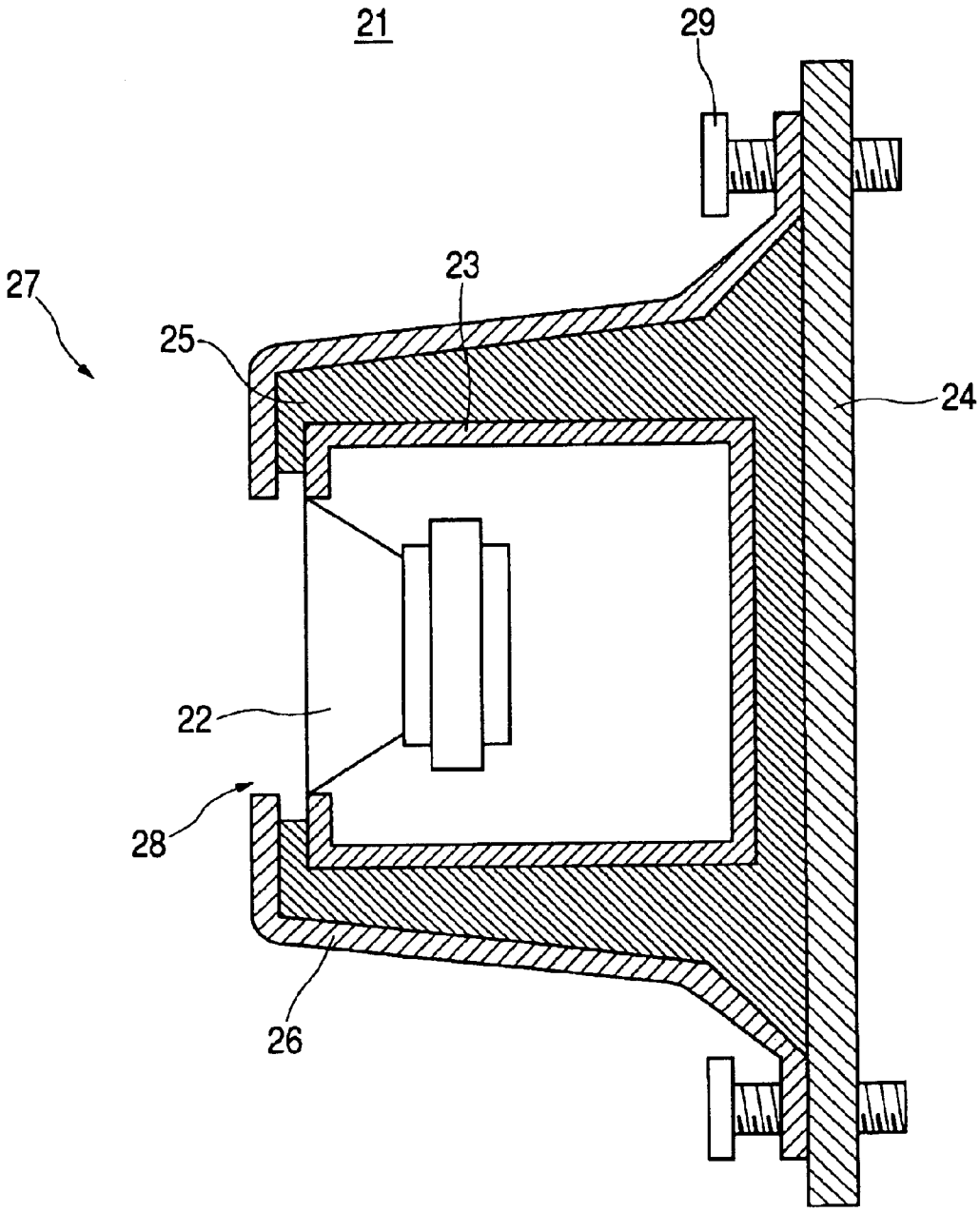
FIG. 1 is a schematic sectional view of a mounting structure of a speaker for vehicle device 21 according to an embodiment of the invention.

FIG. 1 shows a mounting structure of a speaker for vehicle device 21 according to an embodiment of the invention. In this embodiment, the speaker for vehicle device 21 employs the state where a speaker unit 22 is mounted in a speaker box 23. The speaker box 23 is attached to the surface of a wall member 24 such as an interior member of a vehicle body or side plate outside the vehicle body. The periphery of the speaker box exclusive of the portion where the acoustic output is derived from the speaker unit 22 is covered with a buffer material 25 made of a vibration absorbing material such as felt. On the back side of the speaker box 23, the buffer material 25 intervenes between the speaker box 23 and the wall member 24. The speaker box 23 is secured to the wall member 24 by a holding member 26 from the inside of a passenger room 27. The holding member 26 is an interior member or designed member which faces the passenger room 27. The holding member 26 may be made of synthetic resin, considering the appearance. An opening 28 is provided at the portion of the holding member 26 where the acoustic output is derived from the speaker box 23 so that the acoustic output into the passenger room is not deteriorated. The opening 28 may be covered with a breathable net, coarse close or grille. The periphery of the holding member 26 is secured to the wall member 24 by bolts 29. The bolts 29 are fixed using the corresponding nuts or female screws made in the wall member 24.

When the speaker unit 22 is designed to perform acoustic emission directly from a diaphragm such as an ordinary cone diaphragm or a dome diaphragm, the acoustic emission from the speaker box 23 is made from the front side of the attaching portion of the speaker unit 22. When the speaker unit 22 is designed to lead the acoustic output from the diaphragm to a horn, the acoustic emission is made from the opening of the horn. Where the speaker box 23 is provided a bass reflex port, the acoustic emission is also made from the bass reflex port. The buffer material 25 covers the speaker box 23 exclusive of these portions for acoustic emission.

If the speaker unit 22 is a treble speaker, the speaker unit 22 can be directly covered with the buffer material 25 without using the speaker box 23. This is because in reproduction of treble sound, a back cavity can be assured sufficiently even when the frame of the speaker unit 22 is closed on the back side (a small volume suffices the reproduction of treble sound).

Figure 2:
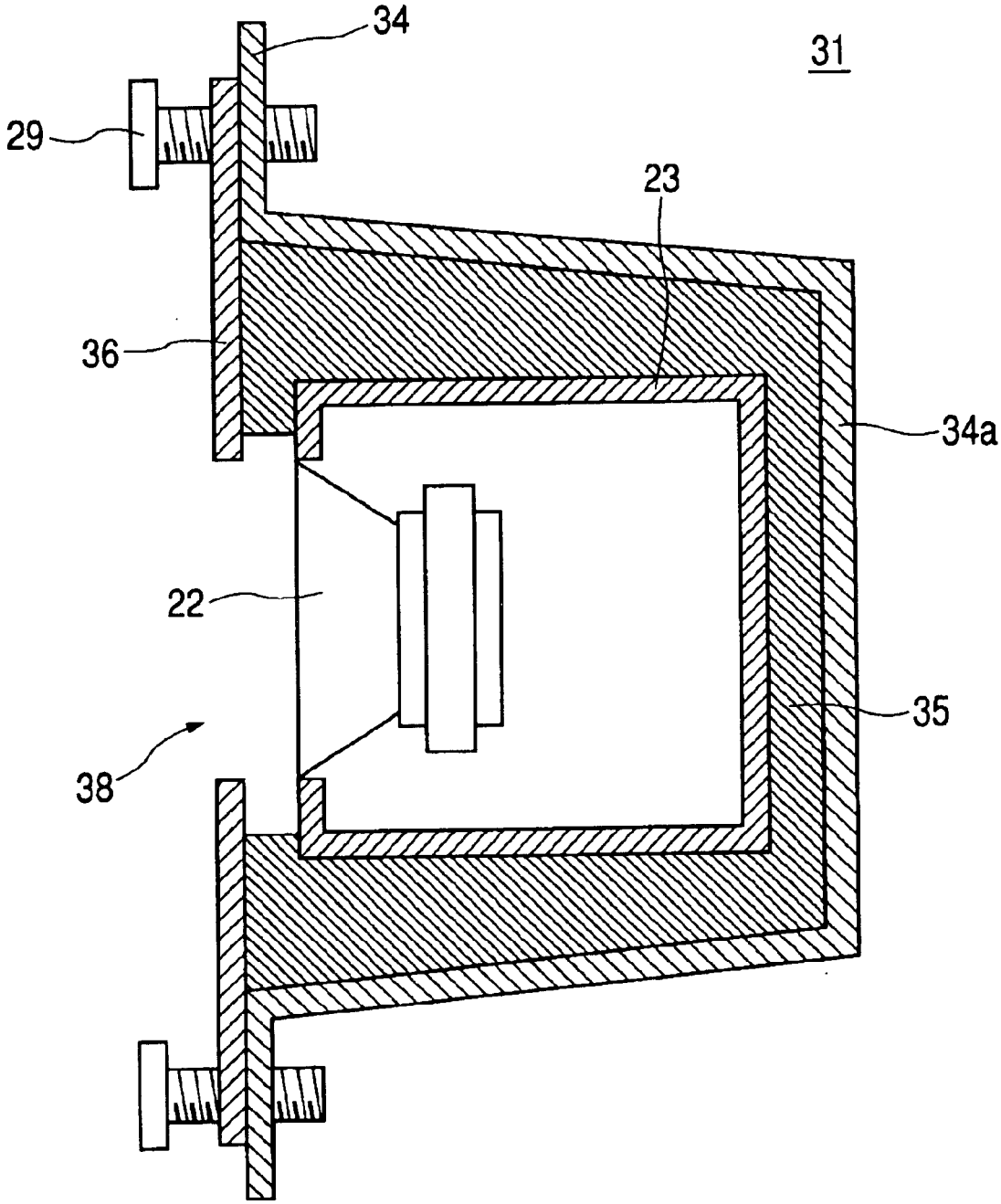
FIG. 2 is a schematic sectional view of a mounting structure of a speaker for vehicle device 31 according to another embodiment of the invention.

FIG. 2 shows a mounting structure of a speaker for vehicle device 31 according to another embodiment of the invention. In this embodiment, like reference numerals referring to like elements in the embodiment of FIG. 1 are used, and repeated explanation will not be given. In this embodiment, a speaker box 23 is fixed in a concave portion 34*a* made in a wall member 34 such as an interior member or side plate of the vehicle body 23. The concave portion 34*a* has a size that is larger than the speaker box 23 and enough to fill a buffer material 35 on the periphery of the speaker box 23. The buffer material 35 may be the same as the buffer material 25 in FIG. 1. However, the depth of the concave portion 34*a* is not necessarily enough to accommodate the entire speaker box 23. From the side of the passenger room 27 of the concave portion 34*a*, the buffer material 35 is pressed by a holding member 36 that is an interior member or a designed member to fix the speaker box 23. A portion of the holding member 36 facing a portion where the acoustic output is generated from the speaker box 23 has an opening 38.

Figure 4:
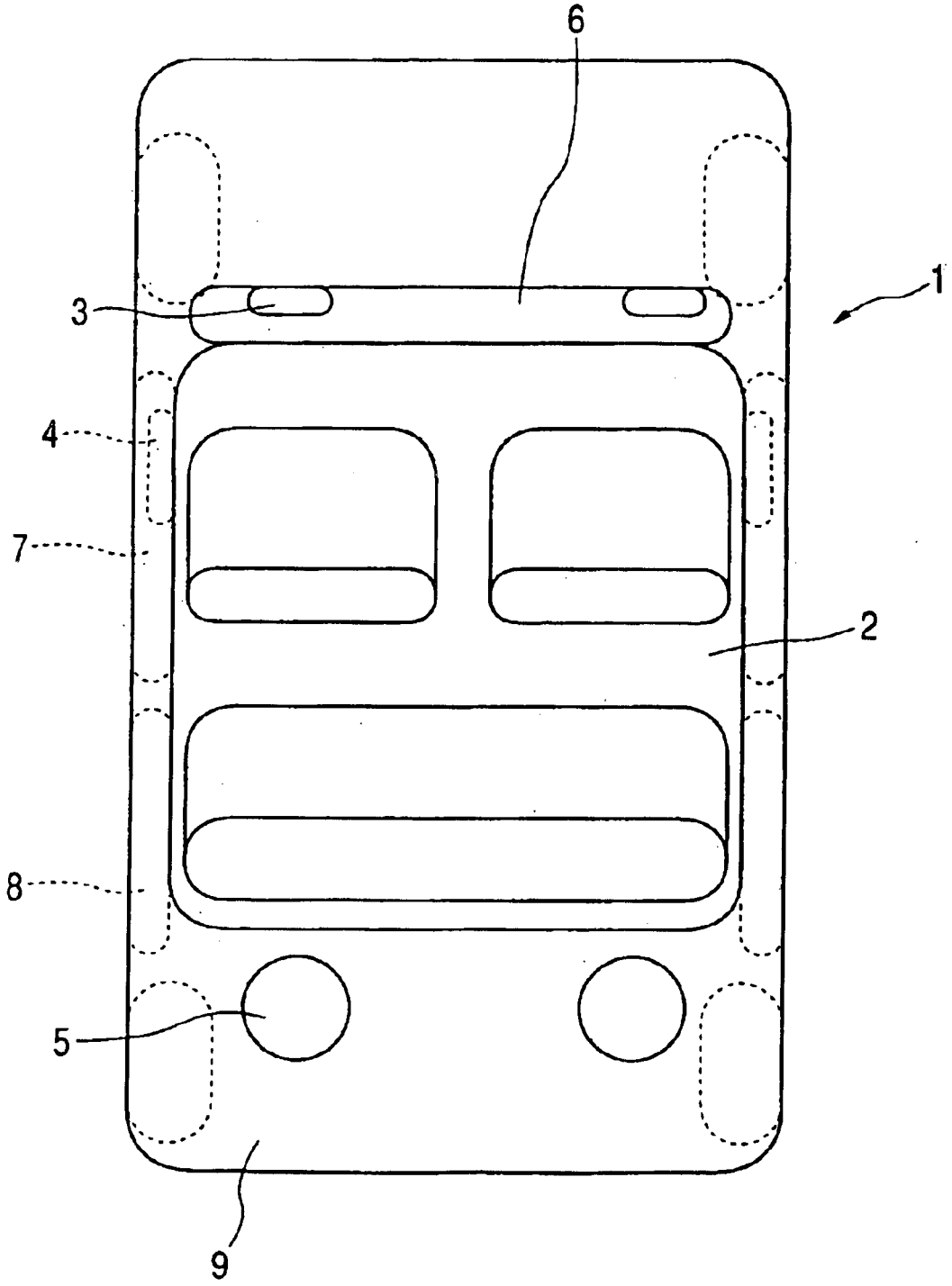
FIG. 4 RELATED ART
FIG. 4 is a schematic plan view of a conventional arrangement of speaker for vehicles in a vehicle.
Figure 5B:
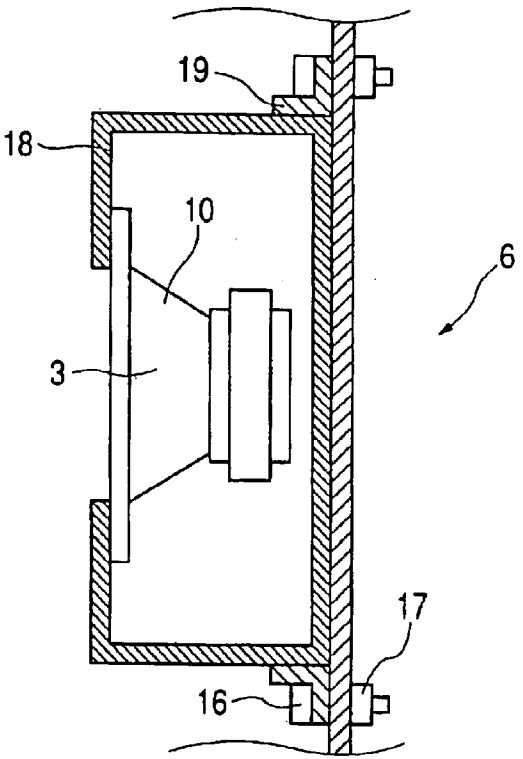
FIG. 5B RELATED ART
FIGS. 5A and 5B are sectional views of a conventional mounting structure of a speaker for vehicle.
Figure 5A:
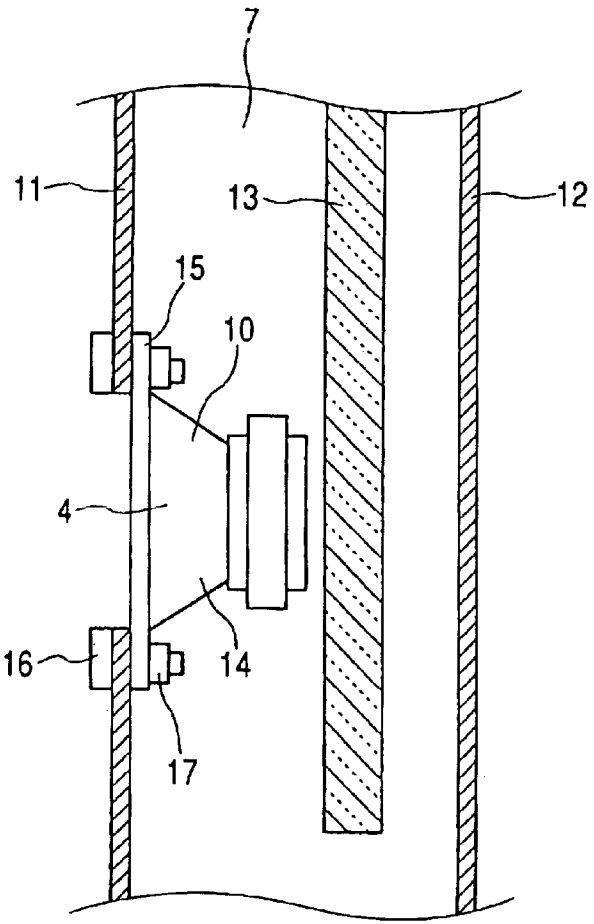
FIG. 5A RELATED ART

In this embodiment, if the concave portion 34*a* has a depth enough to accommodate the entire speaker box 23, the speaker box 23 can be covered with the flat holding member 36 so that the speaker for vehicle 31 does not protrude on the side of the passenger room 27. Therefore, the speaker for vehicle 31 for treble sound, which is small in size, can be embedded in the instrument panel 6 as shown in FIG. 4 so that the quality of the reproduced sound can be improved without protruding the speaker for vehicle into the passenger room.

Figure 3:
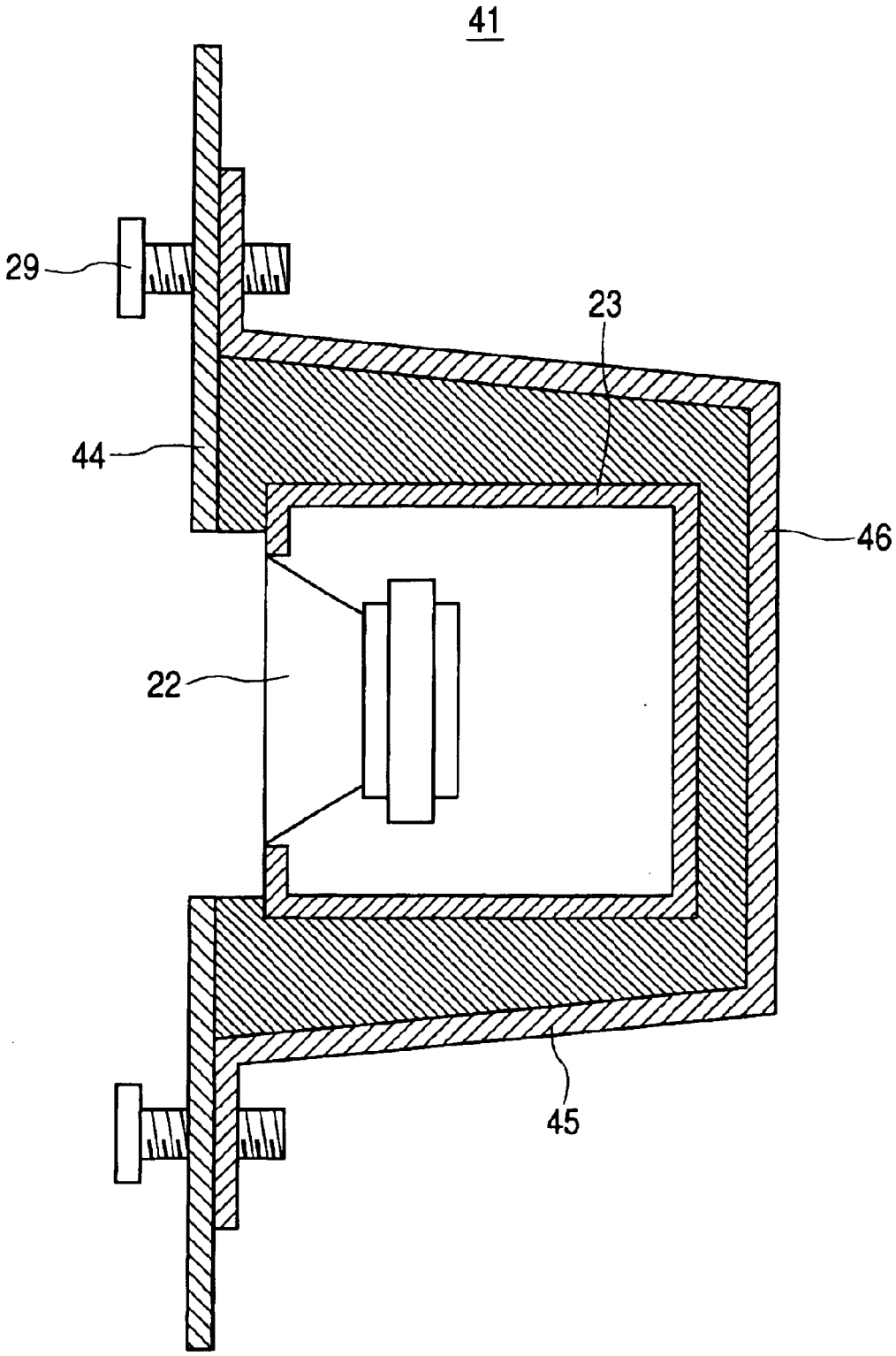
FIG. 3 is a schematic sectional view of a mounting structure of a speaker for vehicle device 41 according to an embodiment of the invention.

FIG. 3 shows a mounting structure of a speaker for vehicle device 41 according to another embodiment of the invention. In this embodiment, like reference numerals referring to like elements in the embodiment of FIG. 1 are used, and repeated explanation will no be given. In this embodiment, the speaker 23 is mounted on the back side of a wall member 44 such as an interior member of a vehicle body. The periphery of the speaker box 23 is covered with a buffer material 45. The buffer material 45 may be the same as the buffer material 25 in FIG. 1. The buffer material 45 is pressed from its back side by a holding member 46 so that the speaker box 23 is secured to the wall member 44 at the outside of the passenger room 27. A portion of the wall member 44 facing a portion where the acoustic output is generated from the speaker box 23 has an opening 48. In this embodiment also, the passenger room 27 can be designed to have no protrusion.

In each of the embodiments, the entire speaker for vehicle 21, 31, 41 exclusive of each acoustic reproduce portion is covered with the buffer material 25, 35, 45. The buffer material 25, 35, 45 is pressed by the holding members 26, 36, 46 to realize the mounting structure of the speaker for vehicle to be secured to the wall member 24, 34, 44, respectively. The portion of the speaker for vehicle 21, 31, 41 exclusive of the portion performing the acoustic reproduction into the passenger room is covered with the buffer material 25, 35, 45. Therefore, even when vibration is generated by the counterforce when the speaker unit 22 makes the acoustic reproduction into the air, the acoustic output due to the vibration is attenuated by the buffer material 25, 35, 45 and disappears from the acoustic output actually reproduced, thereby improving the sound quality of the sound actually reproduced.

In each of the embodiments, the acoustic reproduction is preferably made in the midrange frequency band containing the main part of sound, or the treble range frequency band higher than the midrange frequency band. In this way, if the acoustic reproduction is preferably made in the midrange frequency band containing the main part of sound, or the higher treble range frequency band, the sound quality of the vocal can be improved, and the internal volume necessary for the speaker box 23 is also decreased. The quantity of the buffer material 25, 35, 45 to be used can be decreased, and the holding member 26, 36, 46 can be downsized, thereby reducing the production cost.

As understood from the description hitherto made, in accordance with this invention, since the speaker for vehicle exclusive of a acoustic reproduce portion is covered with the buffer material, even when vibration is generated by the counterforce when the speaker makes the acoustic reproduction for the air, the acoustic output due to the vibration is attenuated by the buffer material and disappears from the acoustic output actually reproduced from the speaker, thereby improving the sound quality of the sound actually reproduced.

In accordance with this invention, since the periphery of the speaker for vehicle in the concave portion of a vehicle body is filled with the buffer material, and the buffer material is pressed by the holding member at the opening of the concave portion, the speaker for vehicle can be surely held.

In accordance with this invention, the speaker for vehicle can be mounted on the back side of the wall by the holding member through the buffer material in such a manner that the speaker for vehicle is mounted from the outside of the wall member of the vehicle body so that the acoustic reproduce portion faces the opening.

In accordance with this invention, the midrange sound or treble sound can be reproduced with high sound quality. The quantity of the buffer material to be used can be decreased, and the holding member can be downsized, thereby reducing the production cost.

What is claimed is:

1. A mounting structure of a speaker for vehicle for mounting the speaker for vehicle on a vehicle body, comprising:

the speaker for vehicle including a speaker box and a speaker unit fixed to the speaker box, the speaker unit having an acoustic reproduce portion;

a buffer material for covering the speaker box; and a holding member for holding the speaker for vehicle by pressing the buffer material.

2. A mounting structure of a speaker for vehicle according to claim 1, wherein at least a portion of the speaker for vehicle is housed in a concave portion provided in the vehicle body, the buffer material fills the periphery of the speaker for vehicle in the concave portion, and the holding member presses the buffer material from the side of an opening of the concave portion facing the passenger room.

3. A mounting structure of a speaker for vehicle according to claim 1, wherein the speaker for vehicle is mounted on the outside of a wall of the vehicle body in a manner that the acoustic reproduce portion faces an opening provided in the wall, and the holding member holds the speaker for vehicle through the buffer material at the outside of the wall.

4. A mounting structure of a speaker for vehicle according to claim 1, wherein the speaker for vehicle performs acoustic reproduction in a midrange frequency band containing the main part of sound, or in a treble range frequency band higher than the midrange frequency band.

* * * * *